United States Patent [19]

Drews et al.

[11] Patent Number: 4,700,495

[45] Date of Patent: Oct. 20, 1987

[54] HEATER ASSEMBLY AND MOUNTING ARRANGEMENT FOR A DRYER

[75] Inventors: Reinhold A. Drews, Lincoln Township, Berrien County; Karl Jautakis, Chikaming Township, Berrien County; Mark E. Kuyper, Grandville, all of Mich.

[73] Assignee: Whirlpool Corporation, Benton Harbor, Mich.

[21] Appl. No.: 909,861

[22] Filed: Sep. 22, 1986

[51] Int. Cl.[4] ..... F26B 11/04

[52] U.S. Cl. ..... 34/133; 219/375; 219/537

[58] Field of Search ..... 34/133; 219/375, 374, 219/400, 532, 537, 525

[56] References Cited

U.S. PATENT DOCUMENTS

| | | | |
|---|---|---|---|
| 2,830,384 | 4/1958 | Zehrbach . | |
| 2,830,385 | 4/1958 | Smith | 34/133 |
| 3,790,751 | 2/1974 | Kuhn | 34/133 |

*Primary Examiner*—Larry I. Schwartz

*Attorney, Agent, or Firm*—Hill, Van Santen, Steadman & Simpson

[57] ABSTRACT

A heater assembly and mounting arrangement are provided for a clothes dryer in which a heater box carrying the heater element is positioned within the dryer cabinet and is accessible for servicing and replacement from the front of the dryer. A rear end of the heater box slip fits into an air conduit which channels heated air into the dryer drum. The heater box is secured by a single bracket near the front of the dryer. The heater element is separately removable from the heater box, being slidably mounted between opposed grooves in the box and secured by a single threaded fastener.

14 Claims, 6 Drawing Figures

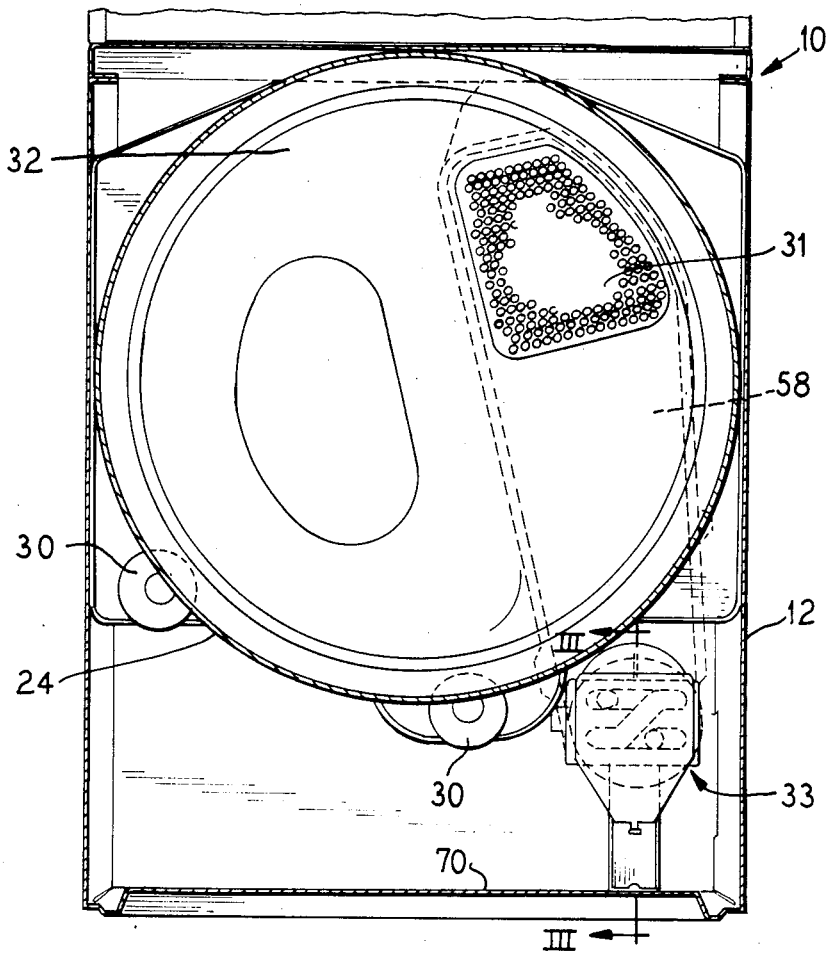
FIG. 2
FIG. 6
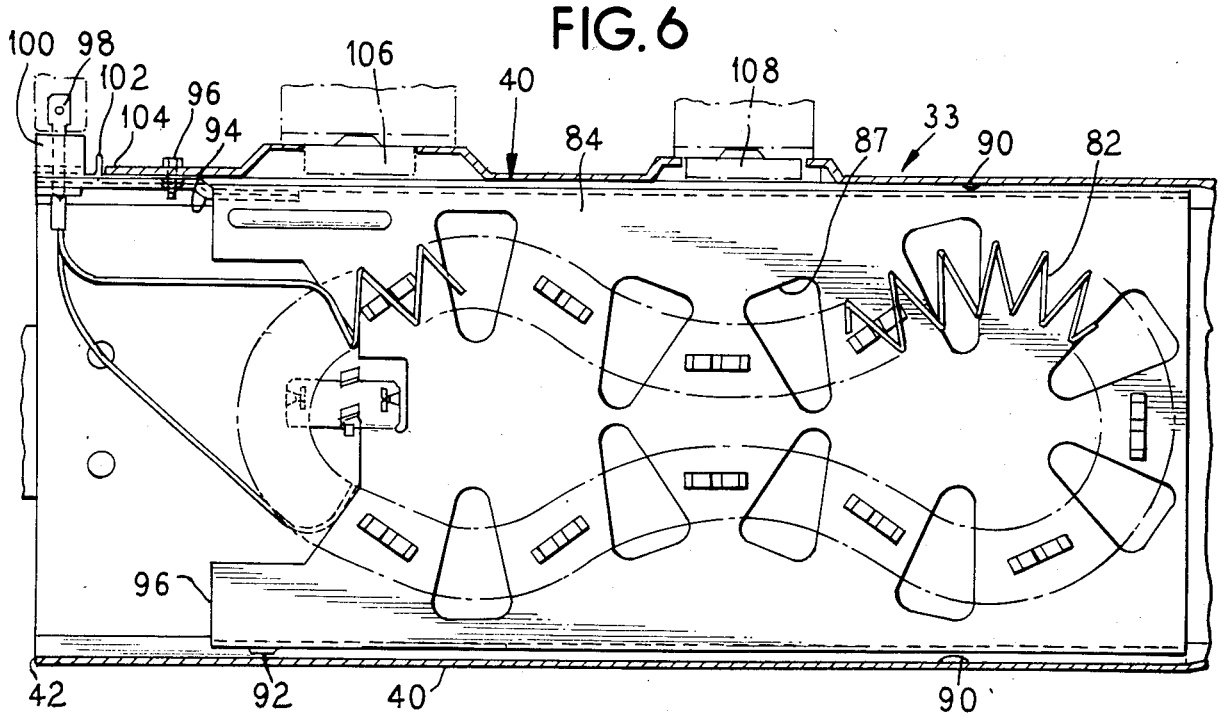

HEATER ASSEMBLY AND MOUNTING ARRANGEMENT FOR A DRYER

BACKGROUND OF THE INVENTION

1. Field of the Invention

The present invention relates to clothes dryers and more particularly to a heater assembly and mounting arrangement for use in a clothes dryer utilizing electric heat.

2. Description of the Prior Art

In clothes dryers it is required that there be a source of heat to sufficiently heat air drawn through the dryer by a blower in order to effectively dry a wet clothes load. Such heat sources include gas burners as well as electric resistance elements.

In the case of electrical resistance elements used as a heating source, it is common that the resistance element be placed within an air conduit or chamber immediately upstream of an air inlet opening which leads into the interior of the dryer drum. Normally, this air conduit or chamber is located on the back wall of the dryer cabinet. For example, such a construction as shown in U.S. Pat. No. 4,314,409 in which the heater 18 is mounted behind the rear bulkhead of the dryer in a vertical orientation just upstream of the air inlet openings in the rear bulkhead.

The placement of the heating element at the back of the dryer requires that the back of the dryer be accessible if service to the heating element is required. This often requires the dryer, which is heavy and bulky, to be pulled out of an installed location and sometimes requires the service man to work in a somewhat cramped space. Thus, it would be advantageous to mount the heater element such that it could be serviced from the front side of the dryer.

SUMMARY OF THE INVENTION

The present invention provides for a construction for a heater box in which the heater box and the heater element are accessible from a front of the dryer and can be completely removed from the dryer cabinet without requiring the back of the dryer to be accessed.

The present invention provides a heater box which has a frustoconical end receivable in a rear air chamber opening with a slip fit. A front end is attached to a mounting bracket which is in turn secured to the frame of the dryer cabinet closely adjacent to the front of the dryer. A removable front toe panel of the dryer cabinet conceals the heater box, and upon removal of the toe panel the heater box is readily accessible and can be easily removed by detaching the mounting bracket from the frame thereby permitting the entire heater box to be withdrawn from the cabinet because of the slip fit of the frustoconical end at the rear wall of the cabinet.

The bracket spaces the heater box above an inner floor or bottom panel of the cabinet to permit the passage of a dryer exhaust conduit to pass below the heater box as is more specifically described in copending application Ser. No. 924,309. The mounting bracket is resilient and acts as a spring to continuously bias the heater box rearwardly into engagement with the air chamber opening.

The repositioning of the heating element from a normally vertical orientation behind the rear bulkhead to a horizontal orientation within the cabinet below the dryer drum poses a problem not present in the previous mounting arrangements. When the heating element becomes hot, the coil of the element sags due to gravity and, since the heating coil is carried on a flat metal plate, the chance of the coil sagging into contact with the metal plate and thereby short circuiting under extreme conditions becomes a possibility. Therefore, in addition to mounting the coil on insulator posts, the plate carrying the heater coil is perforated by a series of openings spaced between the insulating posts to remove any metal below those portions of the coil which are subject to sag. The holes in the plate also enhance the force convection heat transfer of the heat element.

The coil carrying plate can be slid into and out of the heater box by means of opposed grooves formed in the side walls of the heater box. A single threaded fastener is utilized to secure the coil carrying plate into position.

A heat shield is attached to the bracket between the front end of the heater box and the toe panel to reflect heat back into the heater assembly making it more efficient and to prevent the toe panel from getting hot. The shield can be removed for easy access to the heat element without requiring removal of the heater box.

BRIEF DESCRIPTION OF THE DRAWINGS

FIG. 2 is a front sectional view of the dryer illustrating the location of the heater box.

FIG. 6 is a sectional view through the heater box taken generally along the lines VI—VI of FIG. 4.

DESCRIPTION OF THE PREFERRED EMBODIMENTS

Figure 1:
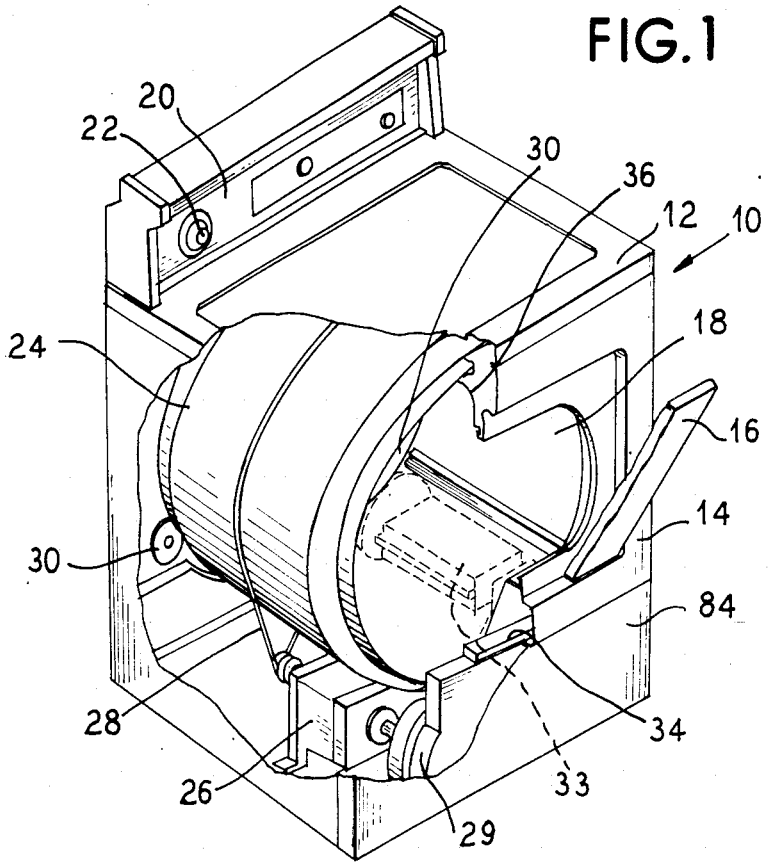
FIG. 1 is a perspective view of a dryer embodying the principles of the present invention.

In FIG. 1 there is illustrated a horizontal axis clothes dryer embodying the principles of the present invention. The dryer is comprised of a cabinet 12 having a front panel 14 with an openable door 16 revealing an access opening 18. A console 20 having presetable controls 22 thereon allows an operator to preselect a program of automatic drying and tumbling in a laundry drying process. The door 16 in the front panel 14 of the cabinet 12 permits access through the access opening 18 into the interior of a drum 24 having open ends which is rotatably mounted within the cabinet 12.

Below the drum but within the cabinet 12 on one side of the cabinet there is provided an electric motor 26 which rotatably drives the drum by means of a belt 28 and also drives a blower 29. A stationary back wall 32 is provided which has inlet openings 31 (FIG. 2) within the drum for the passage of air circulated by the blower 29 which is used in the drying process. The blower 29 draws air from the drum 24 through a lint filter 34 positioned below the door 16. A heater 33 conditions the air before it enters the drum through the inlet openings. The stationary back wall also has mounted thereon two rollers 30 which support the rear portion of the drum 24. A front portion of the drum is supported by a pair of additional rollers (not shown). A stationary drum front bulkhead 36 is provided between the dryer front panel 14 and the rotating drum 24.

The particulars of the heater 33 are shown in greater detail in FIGS. 2–6.

In FIG. 2 it is seen that the heater 33 is positioned within the dryer cabinet 12 below the drum 24 and on a side opposite that of the placement of the motor 26 shown in FIG. 1. As illustrated more particularly in FIGS. 3, 4 and 6 it is seen that the heater 33 is comprised of a plurality of elements including a heater box 40 which is substantially rectangular in cross section from an open front end 42 rearwardly to a transition area 44 where it flairs outwardly to a circular circumference at 46 from which it continues rearwardly with a frustoconical shape to terminate at an open rear end 48 having a circular circumference.

The rectangular portion of the box can be constructed from a single piece of sheet metal having an upstanding crimped edge 50 forming a rib extending along the front to rear length of the heater box 40 which provides structural strength for the box. The box 40 has a pair of opposed sidewalls 52 each having an interior groove or channel 54 formed therein by appropriate bends in the sheet metal. The front end 42 of the heater box 40 comprises a substantially rectangular opening through which air is drawn by action of the blower 29. The rear end 48 of the heater box 40 is received in a sleeve portion 56 of an air conduit or chamber 58 which connects the heater box 40 to the air inlet openings 31 extending through the rear wall 32 of the dryer drum.

The sleeve portion 56 has a front end 58 which is flared outwardly toward the heater box 40 to snugly mate with the frustoconical shape of the rear end 48 of the heater box. In this manner, a slip fit is provided between the heater box 40 and the sleeve portion 56 precluding the need for additional fasteners between the heater box 40 and the sleeve portion 56. Thus, manual access to the sleeve portion area is not required for assembly or disassembly of the sleeve and heater box connection in that the heater box can be guided rearwardly to engage with the sleeve portion from the front of the dryer.

A support bracket 62 is provided which is attached at a top end 64 near the front end 42 of the heater box 40 by a pair of threaded fasteners 66. A bottom end 68 of the bracket 62 is secured to a bottom wall 70 of the dryer cabinet 12, again by a pair of threaded fasteners 72. The bracket 62 is sufficiently tall to space the heater box 40 above the bottom wall 70 of the dryer cabinet 12 to permit an air exhaust conduit (indicated by dashed lines 73 in FIG. 3) to pass beneath it to exit through a sidewall in the dryer cabinet as is described in greater detail in pending application Ser. No. 924,309.

Figure 3:
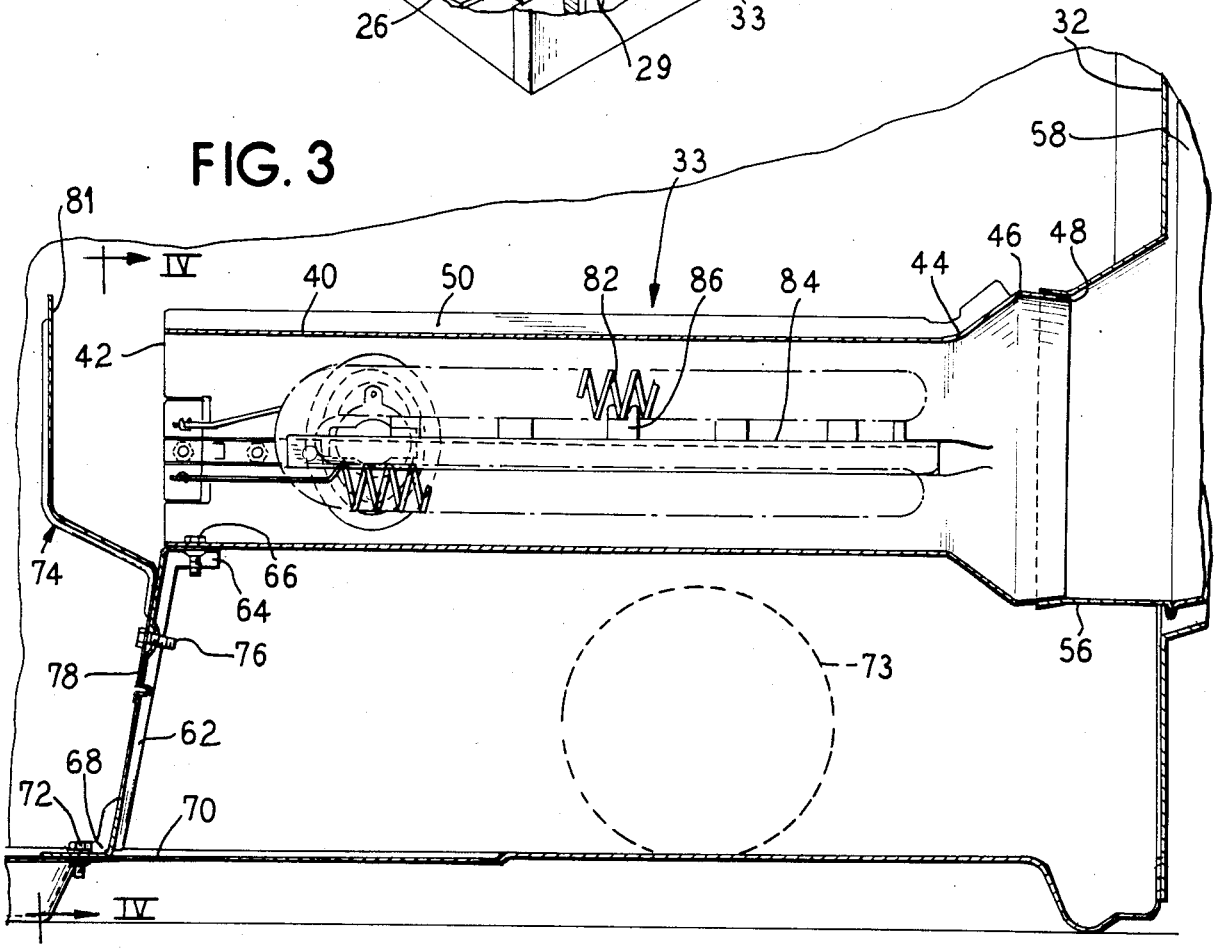
FIG. 3 is a sectional view through the heater box taken generally along the line III—III of FIG. 2.
Figures 4, 5:
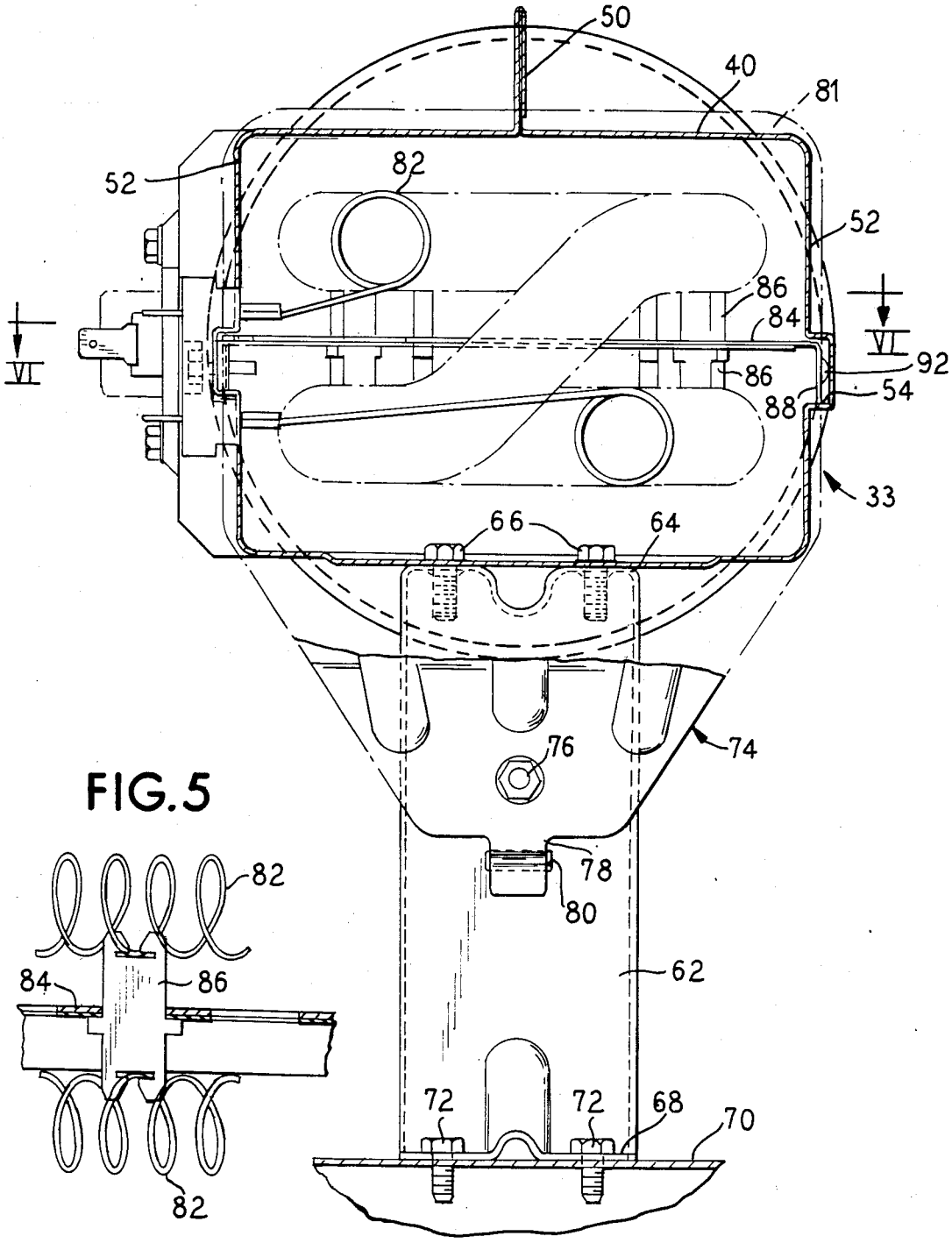
FIG. 4 is a front view of the heater box taken generally along the line IV—IV of FIG. 3.
FIG. 5 is a partial view of the heating element and insulation posts.

A reflective shield member 74 is attached to a front side of the bracket 62 by a threaded fastener 76 and also includes a bent tab 78 which extends into a punched opening 80 in the bracket 62 to prevent rotation of the reflective shield 74 about the fastener 76 on the bracket 62. The reflective shield has a generally rectangularly shaped upper end 81 which has an outer periphery slightly larger than the generally rectangular front open end 42 of the heater box 40. The upper end 81 of the reflective shield member is spaced forwardly away from the open front end 42 of the heater box and substantially horizontally blocks the open front end 42 as is seen in FIGS. 3 and 4. The upper rectangular portion 81 reflects radiant heat from a heater element 82 positioned within the heater box 40 back through the front open end 42 into the heater box to increase the efficiency of the heater 33. The reflective shield 62 also prevents a removable or openable toe panel 84 positioned on the dryer 10 below the front panel 14 from becoming hot.

The heater element 82 may comprise an electrical resistance element mounted on a plate member 84, but being spaced therefrom by a plurality of insulating posts 86. The resistance element is a coiled wire which is arranged in an open figure eight arrangement suspended by the insulating posts 86 below the plate 84 and continues into an open figure eight arrangement supported by posts 86 above the plate as is illustrated in greater detail in FIG. 5.

The plate 84 is provided with a plurality of openings 87 therethrough positioned between the posts 86. The openings 87 increase the air flow around the heater element which increases the efficiency of the heater while permitting the use of an easy to manufacture plate for a mounting member. The openings also decrease the small possibility of a short which might occur if the coiled wire of the heater element, when hot, were to sag an extreme amount under the influence of gravity. The combination of insulator posts and plate openings will effectively remove the possibility of such shorts.

The plate 84 has a pair of downwardly extending legs 88 running front to rear along either lateral side of the plate. These legs are received within the channels 54 formed in the sidewalls 52 of the heater box. Thus, the plate 84 with the heater element 82 mounted thereon can be placed into the heater box 40 by positioning the legs 88 within the channels 54 and sliding the plate 84 rearwardly.

A pair of dimples 90 are formed in the channels 54 toward the rear of the heater box 40, which dimples project inwardly and function to guide and space the heater plate 84 as it is pushed into its final position. Also, a dimple 92 is formed on one of the downwardly extending legs 88 of the heater plate 84 near a front end thereof to guide the plate and space it from the channel wall. The opposite downwardly extending leg 88 has a mounting arm 94 attached thereto which projects forwardly from a front end 96 of the heater plate. The arm 94 can be secured to the heater box 40 by means of a threaded fastener 96 such that the heater box and heater plate can be moved and installed as a single unit. Such an attachment also permits the heater element to be easily removed from the heater box without removing the heater box from the dryer. Just the single threaded fastener 96 need be removed once the reflecting shield 74 is removed in order to withdraw the heater plate 84 and heater element 82 from the heater box 40.

The heater element 82 has electrical plug connections 98 which are secured through insulated fasteners 100 to a front end of the extension arm 94. Through these connections 98 the heating element 82 can be connected to the control circuitry of the dryer 10. The extension arm 84 has an outwardly turned tab 102 which engages a stop end 104 in the heater box side channel 56 to ensure a positive location of the heater plate 84 relative to the heater box 40. When the tab 102 abuts the stop 104, openings in the heater box 40 and extension plate 94 will align such that the threaded fastener 96 can be threaded into the two parts.

A thermostat 106 and an over temperature sensor 108 are provided in the sidewall of the heater box 40 and are connected to the dryer control circuitry by appropriate electrical connections.

It is thus seen that a heater assembly is provided for a clothes dryer which is easily mounted into the dryer cabinet an removable from the dryer cabinet from the front side of the dryer simply by removal of the toe panel and a pair of threaded fasteners. Either the entirety of the heater assembly can be removed or, if desired, just the heater element can be removed. Even though the heater element is placed in a horizontal position, it is protected against shorts by insulating posts and strategically placed openings in the heater plate. The efficiency of the heater box is enhanced by the provision of a reflective shield in front of a front opening and by the holes in the heater plate.

As is apparent from the foregoing specification, the invention is susceptible of being embodied with various alterations and modifications which may differ particularly from those that have been described in the preceding specification and description. It should be understood that we wish to embody within the scope of the patent warranted hereon all such modifications as reasonably and properly come within the scope of our contribution to the art.

The embodiments of the invention in which an exclusive property or privilege is claimed are defined as follows:

1. A heater assembly for a clothes dryer, wherein said dryer has a rotating drum within a cabinet having an openable front panel and an air conduit with a first opening into said cabinet and a second opening into said drum comprising:

a heater housing having a first open end slidably engagable with said first opening in said air conduit and a second opeend accessible from and mountable near the front of said dryer behind said openable panel;

said heater housing being removably attached to said dryer cabinet by fastening means attached near said second open end of said heater housing; and a heater means mountable within said housing and being accessible and removable from the front of the dryer through said second open end of said heater housing;

whereby, said heater housing and heater means can be serviced and removed from said dryer directly from the front of said dryer without having access to the rear of said dryer.

2. A heater assembly according to claim 1, wherein said heater means comprises an electrical resistance heater element carried on a heater plate.

3. A heater assembly for a clothes dryer, wherein said dryer has a rotating drum within a cabinet having an openable front panel and an air conduit wth a first opening into said cabinet and a second opening into said drum comprising:

a heater housing having a first open end slidably engagable with said first opening in said air conduit and a second open end accessible from and mountable near the front of said dryer behind said openable panel;

a heater means mountable within said heater housing and being accessible and removable from the front of the dryer through said second open end of said heater housing;

said heater means being removably attached to said heater housing by fastening means attached near said second open end of said heater housing, whereby, said heater means can be serviced and removed from said dryer directly from the front of said dryer without having access to the rear of said dryer.

4. A heat assembly according to claim 1, including a reflective shield mounted between said second open end of said heater housing and said openable front panel, whereby radiant heat from said heater means exiting said heater housing through said second open end is reflected back into said heater box.

5. In a dryer having a horizontal rotating drum positioned within a cabinet having a removable front panel, a base plate, and an air conduit with a first opening into said cabinet and a second opening into said drum, a mounting arrangement for an electrical resistance heater comprising:

a heater box having a first open end slidably engagable with said first opening in said air conduit and an open second end accessible from the front of said dryer behind said removable panel;

a heater plate mountable within said heater box;

an electrical resistance heating element mounted on said heater plate; and a mounting bracket attached at one end to said second end of said heater box and at an opposite end to said base plate permitting removability from the front of the dryer of the heater box through an opening defined by removal of said front panel.

6. In a dryer having a horizontal rotating drum positioned within a cabinet having a removable front panel, a base plate, and an air conduit with a first opening into said cabinet and a second opening into said drum, a mounting arrangement for an electrical resistance heater comprising:

a heater box having a first open end slidably engagable with said first opening in said air conduit and an open second end accessible from the front of said dryer behind said removable panel;

a heater plate mountable within said heater box;

an electrical resistance heating element mounted on said heater plate; and a mounting bracket attached at one end to said second end of said heater box and at an opposite end to said base plate;

said bracket acting to continuously bias said heater box into tight engagement with said air conduit such that no additional fasteners are required between said heater box and said conduit.

7. A mounting arrangement according to claim 6, wherein said bracket is secured to said base plate by at least one threaded fastener.

8. In a dryer having a horizontal rotating drum positioned within a cabinet having a removable front panel, a base plate, and an air conduit with a first opening into said cabinet and a second opening into said drum, a mounting arrangement for an electrical resistance heater comprising:

a heater box having a first open end slidably engagable with said first opening in said air conduit and an open second end accessible from the front of said dryer behind said removable panel;

a heater plate mountable within said heater box an electrical resistance heating element mounting on said heater plate; and a mounting bracket attached at one end to said second end of said heater box and at an opposite end to said base plate;

said heater box having a pair of opposed grooves formed in the sidewalls thereof to slidingly receive said heater plate through said open second end, whereby said heater plate can be accessed and removed from said heater box from the front of said dryer.

9. A mounting arrangement according to claim 8, wherein said heater plate is mounted horizontally within said heater box and said heating element is mounted above and below a top and bottom side of said heater plate, said heater plate further having a plurality of holes therethrough to enhance convection transfer of heat from said heating element to the air within said heater box.

10. A mounting arrangement according to claim 9, wherein said heating element comprises a coiled wire supported on insulated pillars above and below said heater plate, said pillars being placed beteen said holes in said heater plate.

11. A mounting arrangement according to claim 5, wherein said heater plate is secured to said heater box by at least one threaded fastener.

12. A mounting arrangement according to claim 5, including a reflective shield mounted on said bracket and having a portion interposed between said second open end of said heater box and said removable front panel, whereby radiant heat from said heating element exiting said heater box through said second open end is reflected back into said heater box.

13. A mounting arrangement according to claim 5, wherein said bracket is long enough to support said heater box above said bottom plate a sufficient distance such that an exhaust air conduit can be passed below said heater box.

14. A heater assembly and mounting arrangement for use in a clothes dryer, wherein said dryer has a horizontal rotating drum within a cabinet having a removable front panel, a base plate and an air conduit with a first opening into said cabinet and a second opening into said drum comprising:

a heater box having a first open end slidably engagable with said first opening in said air conduit and an open second end accessible from the front of said dryer behind said removable panel;

a heater plate mountable within said heater box;

said heater box having a pair of opposed grooves formed in the sidewalls thereof to slidingly receive said heater plate through said second open end;

an electrical resistance heating element mountable on said heater plate;

said heater plate being mounted horizontally within said heater box and said heating element being mounted above and below a top and bottom side of said heater plate, said heater plate having a plurality of holes therethrough to enhance convection transfer of heat from said heating element to the air within said heater box; and bracket attached at one end to said second end of said heater box and at a second end to said base plate, said bracket acting to continuously bias said heater box into tight engagement with said air conduit such that no additional fasteners are required between said heater box and said air conduit;

whereby, said heater box and heater element are removable from said dryer cabinet from the front of said dryer.

* * * * *